United States Patent [19]

Sawa et al.

[11] 4,098,048

[45] Jul. 4, 1978

[54] TENNIS BALL PUMP

[76] Inventors: Kenneth Bruno Sawa, 5081 Sumac Ridge; Gordon E. Mehaffy, 18891 Via Encanto, both of Yorba Linda, Calif. 92686

[21] Appl. No.: 761,815

[22] Filed: Jan. 24, 1977

[51] Int. Cl.[2] ..... B65B 31/04

[52] U.S. Cl. ..... 53/7; 53/88; 141/329

[58] Field of Search ..... 141/329, 330, 38, 1-10, 141/19, 46-67, 94, 95, 99-105, 114, 197; 53/7, 88, 22 R, 79, 81, 112 R; 156/94, 145, 146, 147; 273/61 D; 29/401 B, 401 C

[56] References Cited

U.S. PATENT DOCUMENTS

| | | | |
|---|---|---|---|
| 2,819,573 | 1/1958 | Whittington | 53/7 |
| 2,926,705 | 3/1960 | Dorn | 53/7 |
| 3,699,739 | 10/1972 | Burdwood | 53/7 |
| 3,921,977 | 11/1975 | Brink | 53/7 |
| 3,929,174 | 12/1975 | Isnardi | 53/7 |
| 3,932,977 | 1/1976 | Ringler | 53/7 |
| 3,974,622 | 8/1976 | Stubblefield | 53/7 |

*Primary Examiner*—Houston S. Bell

[57] ABSTRACT

A device for inflating tennis balls having a sharpened needle which punctures the wall of the ball which needle inserts both air and a sealant material. A sharpened needle is held by a frame, the needle being hollow to permit passage of air and sealant material. A hollow conduit is affixed to the needle and a pressure sensitive member is positioned in the hollow conduit. Air and a ball sealant is pumped through the hollow conduit into the tennis ball. After all the sealant has been injected additional air is injected in an amount to cause the pressure inside the ball to exceed the desired pre-set pressure. Excess air is removed from the ball through the hollow needle and through a pressure sensitive member until the desired pre-set pressure inside the ball is attained.

14 Claims, 6 Drawing Figures

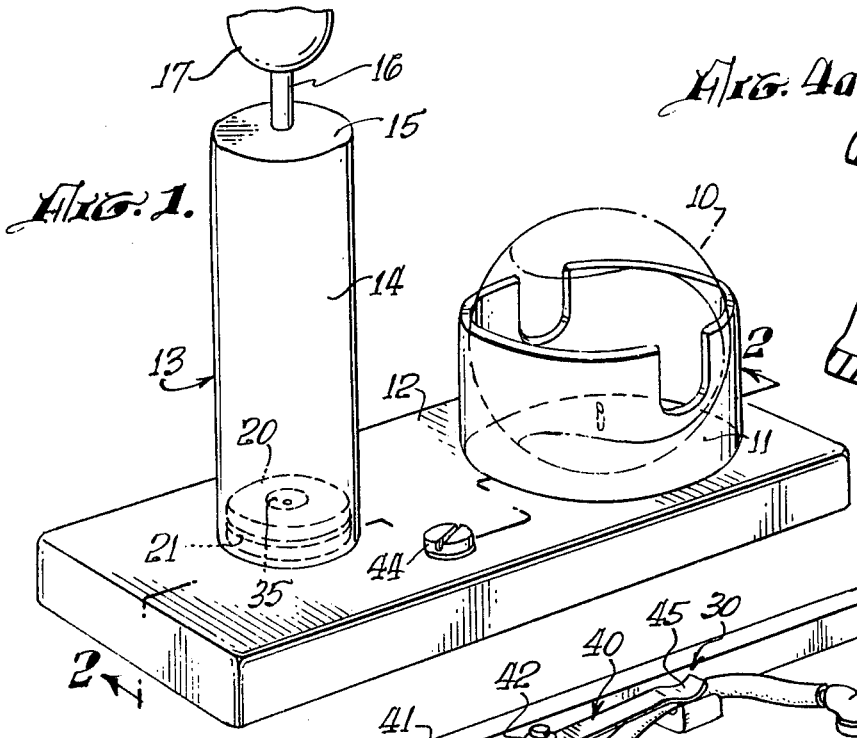
FIG. 1.
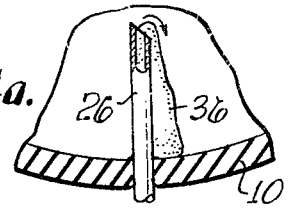
FIG. 4a.
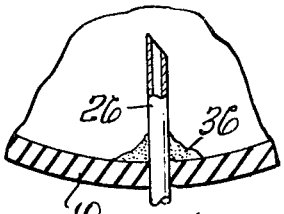
FIG. 4b.
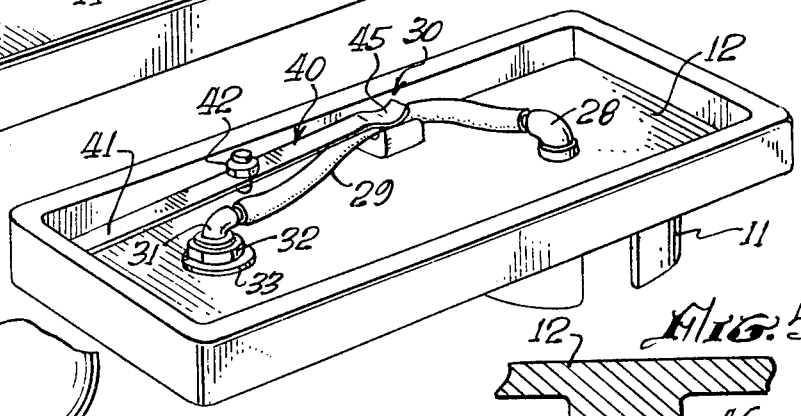
FIG. 3.
FIG. 5.
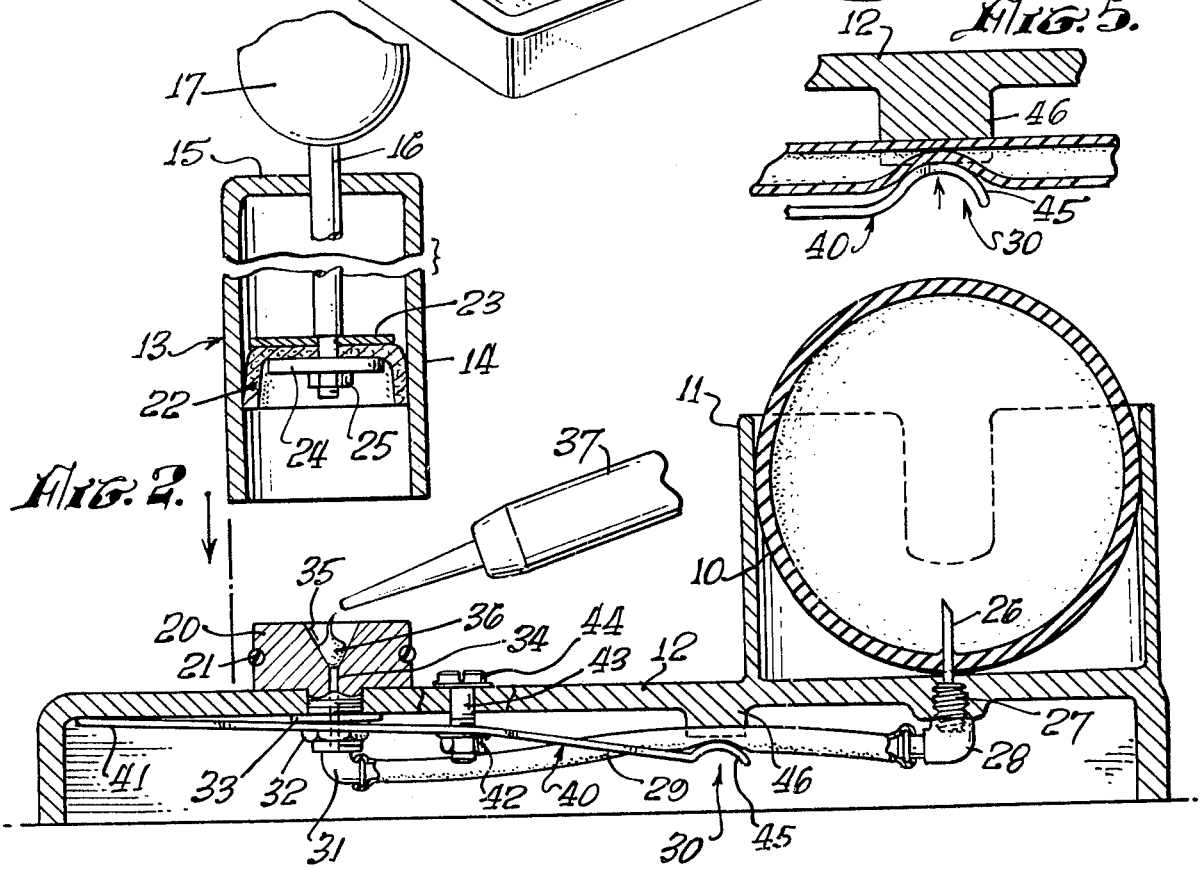
FIG. 2.

TENNIS BALL PUMP

BACKGROUND OF THE DISCLOSURE

Most inflatable objects are provided with a valve to permit the entry of air or other gas into the tire, ball, or the like to inflate the same. Some objects such as tennis balls, hand balls, squash balls, racket ball balls and other relatively thick-skinned balls are not provided with any valve and instead are generally considered leakproof enough to be used without further inflation. Unfortunately, in many sports and particularly in tennis, the ball will lose internal pressure by the passage of gas molecules through the wall of the ball. The internal pressure often decreases to an extent that the rebound of the ball is reduced and the ball must either be discarded or used in its unsatisfactory condition of inflation.

In the particular instance of tennis balls, various approaches have been taken to help reduce the tendency of tennis balls to partially deflate. First, almost all tennis balls are packed in a pressurized can so that before the can is opened, there is little or no tendency for air to migrate from the inside of the ball to the outside. Numerous devices are commercially available which will permit the user to re-pressurize the can or to insert the balls in another container which may then be pressurized to reduce deflation in periods of non use. Such devices, however, are not capable of reinflating a deflated ball in a reasonable time but merely can reduce the tendency of the balls to deflate.

There is thus the need for a device to reinflate a deflated tennis ball.

SUMMARY OF THE INVENTION

It is an object of the present invention to provide a simple, inexpensive device for inflating tennis balls to an accurate predetermined pre-set pressure.

The present invention is for a device and process for inflating tennis balls to a pre-set pressure. The device has a sharpened needle which is held by a frame. The needle is hollow and is connected to a hollow conduit. The needle may be inserted through the wall of a tennis ball and air may be passed through the hollow portion of the needle. A hollow conduit is affixed to the needle and a pressure sensitive member is positioned along the hollow conduit. Sealant insertion means are also affixed to the frame and connected to the hollow conduit. In operation, the tennis ball is placed over the hollow sharpened needle. An amount of sealant is injected into the hollow conduit and an air pump is then used to push the sealant into the tennis ball after which further air is pumped in until the pressure in the tennis ball is in excess of the desired pressure. This excess air flushes the conduit and needle of sealant and then passes backwardly through a pressure sensitive member. At this point, the ball is removed from the needle and the sealant covers the hole formed by the needle thereby sealing the pre-set amount of air within the ball.

BRIEF DESCRIPTION OF THE DRAWINGS

FIG. 1 is a perspective view of the tennis ball pump of the present invention.

FIG. 2 is an enlarged cross-sectional view taken along line 2—2 of FIG. 1.

FIG. 3 is a perspective view of the bottom side of the tennis ball pump of FIG. 1.

FIG. 4*a*. is an enlarged cross-sectional view of a portion of a tennis ball and needle of the tennis ball pump of FIG. 1.

FIG. 4*b*. is an enlarged cross-sectional view of a portion of a tennis ball and needle of the tennis ball pump of FIG. 1.

FIG. 5 is an enlarged cross-sectional view of the pressure valve of the tennis pump of the present invention.

DESCRIPTION OF THE PREFERRED EMBODIMENTS

A tennis ball 10 is shown in phantom lines held in a cylindrical ball guide 11 located in the upper surface of frame 12 of the tennis ball pump of the present invention. An air pump 13 has a cylindrical wall 14 which is closed at its upper end 15. A pump shaft 16 extends through upper end 15 and a handle 17 is affixed to the upper end of shaft 16. As shown best in FIG. 2, the air pump 13 is removable from and is installed over a cup 20 in airtight engagement by an O-ring 21. The piston 22 is a side sealing piston cup and is held at the end of shaft 16 by a pair of washers 23 and 24 and a nut 25.

Pump 13 does not have a check valve which is associated with typical air pumps. This feature will be important in the pressure adjusting and regulating system used with the present invention and described below. If pump 13 were inserted over cup 20 and handle 17 raised and lowered, air would be forced downwardly by the increase in pressure below piston 22.

In operation, a tennis ball 10 is inserted in guide 11 and is pushed down on needle 26 which pierces the wall of the ball. Needle 26 has a threaded base 27 which holds the needle securely in frame 12. An elbow 28 is also screwed onto threaded base 27. A elastomeric tube 29 permits the passage of air through cup 20 into the interior of ball 10. A pressure regulator indicated generally by reference character 30 will be described in more detail below. An elbow 31 connects elastomeric tube 29 to cup 20. A nut 32 and washer 33 hold cup 20 securely in frame 12. A central opening 34 permits air passage from elastomeric tube 29 through elbow 31 and into a conical opening 35 located in the center of cup 20.

In order to inflate an under-inflated tennis ball, pump 13 is withdrawn from cup 20 and the under inflated ball 10 is inserted over needle 26. Because of pressure regulator 30 no significant amount of air will pass through elastomeric tube 29 from an under inflated ball. The action of pressure regulator 30 will be described below. Next, the sealant 36 is squeezed from sealant tube 37 into conical opening 35. Opening 35 is configured so that filled to the upper surface of the cup, the optimum amount of sealant will be injected. The pump 13 is then inserted over cup 20 and an airtight seal is formed therewith by O-ring 21. Handle 17 is then pumped forcing the sealant through elastomeric tube 29, past pressure regulator 30 and into the interior of the tennis ball through needle 26 as shown best in FIGS. 4*a* and 4*b*. The sealant should be a relatively viscous material of the type commercially used to seal tubeless tires. A tire type sealant sold under the trade name Sealex has been found satisfactory for the present use and other tire or viscous ball sealants would also be expected to perform this function satisfactorily.

After the sealant has been pumped into the ball, a second movement of the pump handle will force air from the pump into the interior of the ball and will also tend to clean out any sealant remaining in the air conduit. After the second lowering of the pump handle, the operator lets go of the handle to determine whether or not the handle starts to rise. If it does not, an additional pump stroke is made and this is continued until when the handle is let loose it starts to rise from the pump 13. When the pressure inside of ball 10 is sufficient to overcome the pressure regulator 30 then air will pass from the ball through elastomeric tube 29, pressure regulator 30 and back into the interior of pump 13. This will cause the piston 22 and connected shaft 16 and handle 17 to rise to a point at which air ceases to flow in a reversed direction through pressure regulator 30. It is at this point that the predetermined pressure in the ball has been reached and the ball is merely lifted from needle 26 and the hole formed by needle 26 is closed by sealant 36. The ball is then ready for play.

This process utilizes the following steps which permit the above-described device to inflate and seal a tennis ball utilizing a minimum of parts. First the tennis ball is placed over the hollow needle. Secondly, a sealant is placed into the hollow conduit. Thirdly, air forces the sealant through the conduit and into the ball. Next, excess air is forced into the ball which cleans the sealant out of the conduit and needle. This excess air is sufficient so that the pressure inside the ball is above the desired pressure. The excess air then passes outwardly from the ball, through the needle and through a pressure sensitive valve which is set for the desired internal pressure of the ball. The ball is then removed and is ready for use.

While various pressure regulators can be used, a particularly effective adjustable and yet inexpensive regulator is shown in the tennis ball pump of the present drawings. As shown in FIG. 3, a leaf spring 40 rests against the inside cover of frame 12 at the end indicated by reference character 41. Nut 42 is secured to leafspring 40 by an adhesive or other means and a screw 43 is threaded into nut 42. Screw 43 has a slotted head 44 which provides a ready means for regulating the biasing pressure which leafspring 40 exerts on elastomeric tube 29.

Elastomeric tube 29 passes over a pressure regulator base 46 and is depressed by a pressure foot 45 formed in leafspring 40. It has been found that a semicircular pressure foot permits the relatively accurate adjustment of the pressure passing through tube 29 and a radius of curvature of about 5/32 of an inch is preferred.

Numerous other pressure regulating means may be used in the practice of the present invention. The essential characteristic is that of pressure relief at a pre-set pressure. This eliminates the need for a pressure gauge. It is convenient that the pressure regulating means utilize a pressure regulator which permits flow in both directions thereby permitting simplicity in design. The leafspring shown in the drawings may have a variety of pressure feet. A "V" shaped foot or a semi-spherical foot could be used. Of course, the leafspring could be replaced by a coil spring, a tension spring or any other biasing means which permits the escape of air through the regulator at a pre-set pressure. Furthermore, the pressure regulator need not be a pressure foot exerted on the side of an elastomeric tube but instead any two-way pressure sensitive valve may be used.

Returning to the device shown in FIG. 2, the adjustment of the pressure by the use of screw 43 may be accomplished by tightening head 44. This increases the biasing of pressure foot 45 against tube 29. The amount of pressure required to force the pressure foot open is thereby increased and thus the passage of air through tube 29 occurs only at a higher pressure. Conversely, by loosening screw 43, the force which pressure foot 45 exerts on tube 29 is decreased and a lower amount of pressure will open pressure regulator 30.

It can be readily seen that the adjustment of the pressure regulator 30 determines the amount of air pressure within tennis ball 10 which will cause piston 22 to rise in pump 13.

The rise of piston 22 and more specifically of handle 17 signals the user that the correct pressure has been reached. It has been discovered that natural rubber has the requisite elasticity to form an accurate pressure regulator in combination with a leafspring having a rounded pressure foot 45. Other elastomers may also be used as long as they have the necessary flexibility and resistance to the sealant used. Other configurations of pressure feet and other means of regulating the pressure at which it takes air to pass through a tube may be used in place of the above-described system although the above-described system is believed uniquely effective and economical. While the present invention has been discussed with respect to inflating of tennis balls it may also be used for hand balls, squash balls and other balls which have heretofore not been considered reinflatable.

The present embodiments of this invention are thus to be considered in all respects as illustrative and not restrictive, the scope of the invention being indicated by the appended claims rather than by the foregoing description. All changes which come within the meaning and range of equivalency of the claims therefore are intended to be embraced therein.

What is claimed is:

1. A device for inflating tennis balls and the like to a pre-set pressure, said device comprising:

a frame;

a sharpened hollow needle held by said frame, said needle having an opening for the passage of air there-through and said needle having sufficient sharpness and strength to penetrate the wall of a tennis ball;

a hollow conduit affixed to said needle;

a pressure sensitive member positioned in said conduit said pressure sensitive member permitting the flow of air into and out of said needle at a pressure equal to the desired air pressure of a ball to be inflated;

cup means supported to said frame and connected to said hollow conduit so that an air conduit exits from said cup means through said pressure sensitive member and to said hollow needle, said cup means having a sealant-holding depression in the upper surface thereof; and air pump means, adapted to be connected to said hollow conduit, said air pump means having a moveable piston whereby movement of the piston forces air into said hollow conduit, through said pressure sensitive member and into said sharpened, hollow needle.

2. The device of claim 1 wherein said pressure sensitive member comprises biasing means having a contact foot positioned on the exterior of an elastic tube which forms a part of said hollow conduit.

3. The device of claim 2 wherein the amount of biasing is adjustable.

4. The device of claim 2 wherein said biasing means is a leaf spring.

5. The device of claim 3 wherein said biasing means is a leaf spring having means for adjusting the tension of said spring located near the longitudinal midpoint thereof.

6. The device of claim 1 wherein said cup means has an external O-ring.

7. The device of claim 1 wherein said cup means has a central conical depression.

8. The device of claim 4 wherein said leaf spring has a simi-circular pressure foot having a radius of approximately 5/32 of an inch and the portion of said hollow conduit which is contracted by the pressure foot is a natural rubber tube against which said pressure foot is held.

9. The device of claim 1 wherein said sharpened needle is surrounded by a cylindrical ball guide positioned on said frame and having a side wall extending vertically away from said frame a distance in excess of the height of said needle from said frame.

10. The device of claim 9 wherein said ball guide has an inside diameter approximately equal to a tennis ball.

11. The device of claim 10 wherein said ball guide has a height from the frame greater than the radius of a tennis ball.

12. The device of claim 1 wherein the air pump means is detachably affixed to said cup means whereby a sealant may be inserted in said cup means and the air pump means thereafter placed over said cup means and the pump means will force any sealant placed in said cup into said hollow conduit, and through said sharpened needle.

13. The device of claim 12 wherein said air pump has a side sealing piston cup.

14. A process for inflating a tennis ball to a pre-set pressure comprising;

inserting a sharpened hollow needle through the wall of a tennis ball;

injecting air and a sealant into said ball;

injecting additional air into said ball after injection of all sealant into said ball said additional air being such that said ball is inflated to a pressure in excess of the desired pre-set pressure; and removing excess air from the ball through said needle and through a pressure sensitive valve which is set to permit air in excess of the pre-set desired pressure to pass therethrough but to prohibit the flow of air under the desired pre-set pressure.

* * * * *